United States Patent [19]

Ishizawa et al.

[11] 3,991,449

[45] Nov. 16, 1976

[54] PROCESS FOR FINISHING TEXTURED KNITTED FABRICS

[75] Inventors: Kazutomo Ishizawa, Osaka; Yoshio Sawa, Kobe, both of Japan

[73] Assignee: Kanegafuchi Boseki Kabushiki Kaisha, Tokyo, Japan

[22] Filed: June 9, 1971

[21] Appl. No.: 151,469

[52] U.S. Cl. ..... 28/72 R; 38/144

[51] Int. Cl.[2] ..... D06C 15/00; D06C 27/00

[58] Field of Search ..... 26/1, 18.5; 38/17, 144; 28/72 R

[56] References Cited

UNITED STATES PATENTS

| | | | |
|---|---|---|---|
| 1,732,340 | 10/1929 | Palmer | 38/144 |
| 2,052,948 | 9/1936 | Simpson | 26/18.5 |
| 2,060,661 | 11/1936 | Cohn | 26/1 |
| 2,712,170 | 7/1955 | Phillips | 26/1 |
| 3,386,193 | 6/1968 | Tewksbury et al. | 38/144 |
| 3,609,891 | 10/1971 | Ishizawa et al. | 38/17 |

OTHER PUBLICATIONS

Textured Yarn Technology, vol. I, Monsanto Textiles Division, Decatur, Alabama, 1967, pp. 385–396.

Sweater Technology A–57 Bicomponent, Monsanto Textiles Division, Decatur, Alabama, 1969, p. 57.

"Finishing of Woven Fabrics," by Eber Midgley, Longmans, Green & Co., New York, 1929, pp. 79, 86–91.

"Dacron," Suggestions for Dyeing and Finishing, Du-Pont Customer Service Bulletin, Oct., 1954.

*Primary Examiner*—Robert R. Mackey

*Attorney, Agent, or Firm*—Woodhams, Blanchard & Flynn

[57] ABSTRACT

A knitted fabric possessing a porosity of at most 80% and a surface contour of at most 6, therefore having a woven fabriclike appearance and hand, is manufactured by uniformly pressing a primary knitted fabric containing at least 50% by weight of thermoplastic synthetic fiber with a presser face under 5 to 35 kg/cm$^2$ pressure at a temperature lower than the melting point of the synthetic fiber but not lower than 90° C so as to compress and heat-set the primary fabric in a thickness of 95 to 55% based on that of the starting primary fabric.

7 Claims, 10 Drawing Figures

Figure 1A:
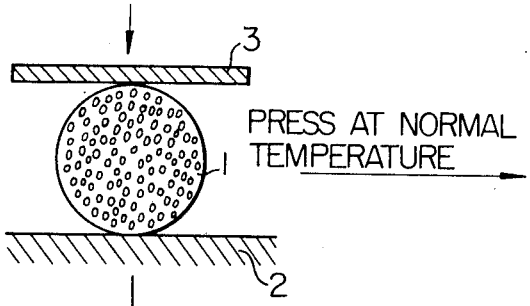

INVENTORS
KAZUTOMO ISHIZAWA
YOSHIO SAWA
BY
Woodhams, Blanchard & Flynn
ATTORNEYS INVENTORS
KAZUTOMO ISHIZAWA
YOSHIO SAWA
BY Wordham, Blanchard & Flynn
ATTORNEYS INVENTORS
KAZUTOMO ISHIZAWA
YOSHIO SAWA
BY
Woodhams, Blanchard & Flynn
ATTORNEYS

PROCESS FOR FINISHING TEXTURED KNITTED FABRICS

The present invention relates to a process of manufacturing a knitted fabric possessing a woven fabric-like appearance and hand and a knitted fabric obtainable therefrom, and more particularly, relates to a process of manufacturing a knitted fabric possessing a woven fabric-like appearance and hand by uniformly pressing a primary knitted fabric containing thermoplastic synthetic fiber with a presser face at a high temperature.

Generally, it is well-known that knitted fabrics prepared from synthetic filament yarns such as polyamide or polyester textured yarns or wool-synthetic fiber blend yarns, have a small weight, high softness, high stretch, high elasticity and high air permeability. Accordingly, the above knitted fabric is used in various uses such as casual wear, town wear and home wear wherein the features and functions of the knitted fabrics can be effectively utilized. On the other hand, it is also well-known that the knitted fabrics as stated above are unsuitable for being used in formal suits and dresses for gentlemen and ladies because they do not have the appearance and hand required in formal wear. Accordingly, the knitted fabrics are limited as regards the uses thereof at the present time.

However, in view of the mass-production of textile fabrics, it is an important advantage of knitted fabrics that they can be manufactured with a high efficiency and speed based upon the remarkable development of knitting machines. That is, knitted fabrics are in a more advantageous position in comparison with the conventional woven fabrics in the sense of mass-production.

Further, it is known that a fabric woven from synthetic fiber yarns has an undesirable hand harder than that of conventional worsted woven fabrics. Accordingly, the features of the knitted fabric, such as the high softness and low weight, can be utilized for obtaining a synthetic fiber-containing fabric having a worsted fabric-like appearance and hand.

If the synthetic fiber-containing knitted fabric can be improved in the appearance and hand thereof while maintaining the above-stated advantages of the knitted fabric, the synthetic fiber-containing knitted fabric can be utilized for gentlemen and ladies formal wear.

The process of manufacturing the knitted fabric having the woven fabric-like appearance and hand is very valuable for expanding the uses of synthetic fibers. However, in the past, it was believed that knitted fabric could not have woven fabric-like appearance and hand the to the absence of a process effective for achieving this aim. Hitherto, the knitted fabrics containing synthetic fibers, accordingly, were mainly used in different fields of demand from that of woven fabrics.

On the background basis as stated above, the inventors have continued a serious study on fabric properties capable of being observed by the naked eye, such as crimping configuration of yarns in stitches observed on the knitted fabric surface and smoothness of surface contour, and luster of the fabric surface in order to develop a process of improving the above properties. As a result from this study, the inventors had found that knitted fabrics containing thermoplastic synthetic fibers can be converted to a fabric having a woven fabric-like appearance and hand by pressing the knitted fabric with a presser face under a specified condition utilizing the plasticity of the synthetic fibers at a high temperature, and, therefore, accomplished the present invention.

It is an object of the present invention to provide a process of manufacturing a knitted fabric containing thermoplastic synthetic fibers and having a woven fabric-like appearance and hand together with the advantages of knitted fabrics.

It is another object of the present invention to provide a process of manufacturing a knitted fabric containing thermoplastic synthetic fibers and being suitable for preparing gentlemen's and ladies' formal dresses and suits.

It is a further object of the present invention to provide a knitted fabric consisting of thermoplastic synthetic fibers and having a woven fabric-like appearance and hand, and therefore, being suitable for gentlemen's clothing and ladies' formal dresses or suits.

Generally, the woven fabrics for gentlemen's wear and ladies' formal dresses were selected from fabrics having a smooth surface and a high apparent density such as worsted fabrics and woolen saxony and flannel, and fabrics having rough stitches, such as home-spun fabrics. The term "woven fabric-like appearance and hand" used herein refers to an appearance and hand such as those of woven fabrics having a smooth surface and high apparent density.

The objects of the present invention can be accomplished by uniformly pressing a primary knitted fabric which contains at least 50% of thermoplastic synthetic fibers based on the weight thereof with a presser face under a pressure of 5 to 35 kg/cm$^2$ applied in the direction of the thickness of the primary knitted fabric at a temperature lower than the melting point of the synthetic fiber but not lower than 90° C for a period of time sufficient for heat-setting the primary knitted fabric in a thickness of 95 to 55% based on the initial primary knitted fabric thickness. Through the above process, the primary knitted fabric is converted to a knitted fabric possessing a porosity of at most 80% and at least one surface having a surface contour of at most 6 and therefore, a woven fabric-like appearance and hand.

The terms "porosity" and "surface contour" as used herein are parameters for defining apparent density and surface smoothness of the fabrics and are measured by the methods as described in detail hereinafter.

Figure 1B:
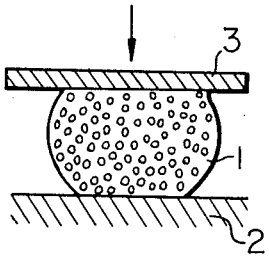
Figure 1B:
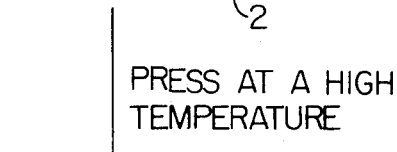
Figure 1C:
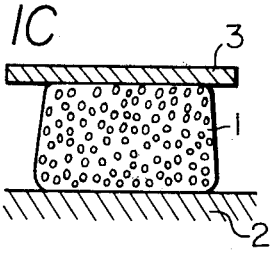
Figure 2:
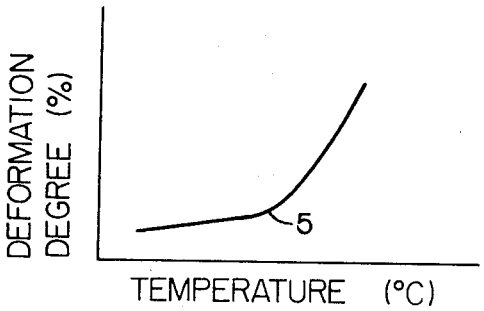
Figure 3:
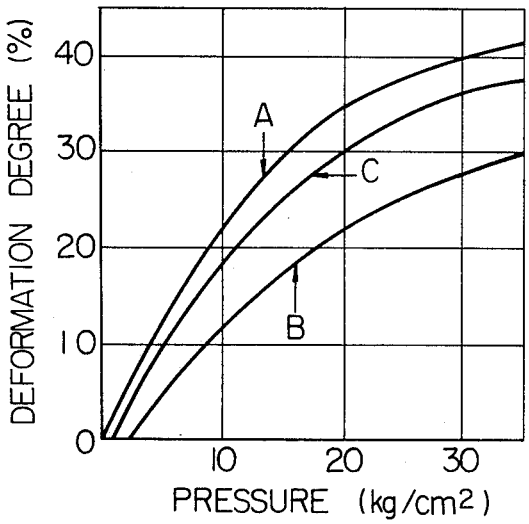
Figure 4:
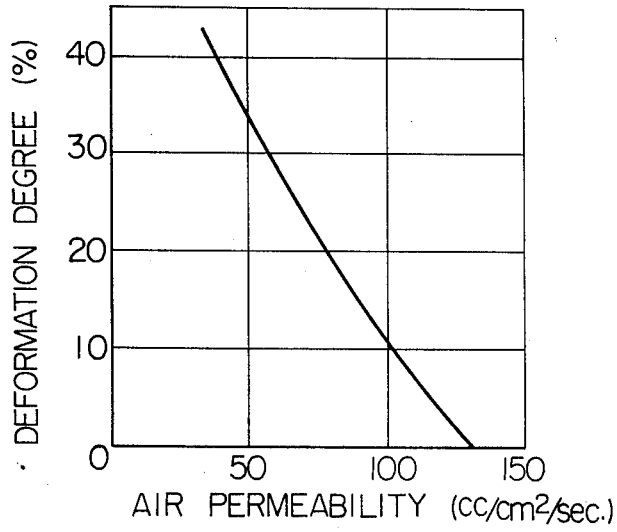
Figure 5:
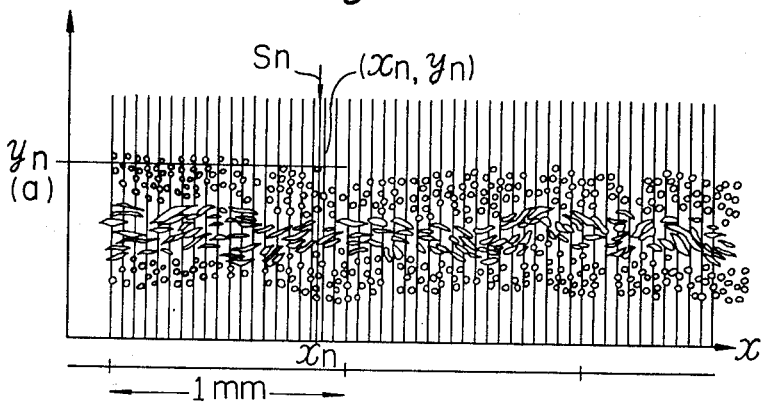
Figure 6:
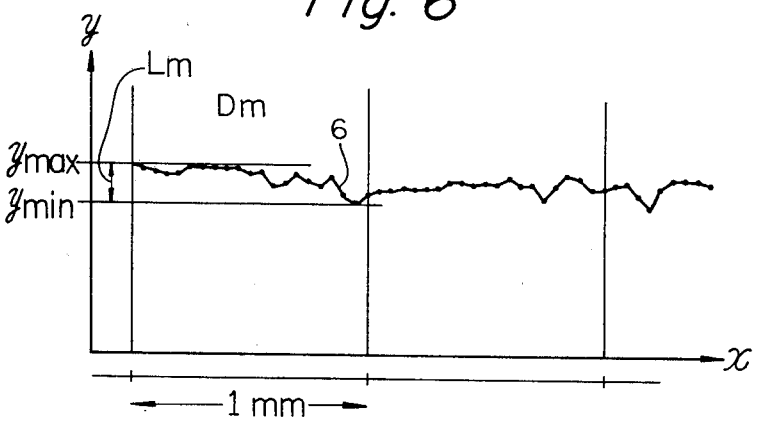
Figure 7:
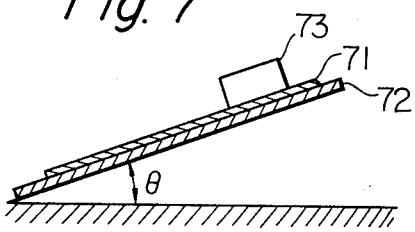
Figure 8:
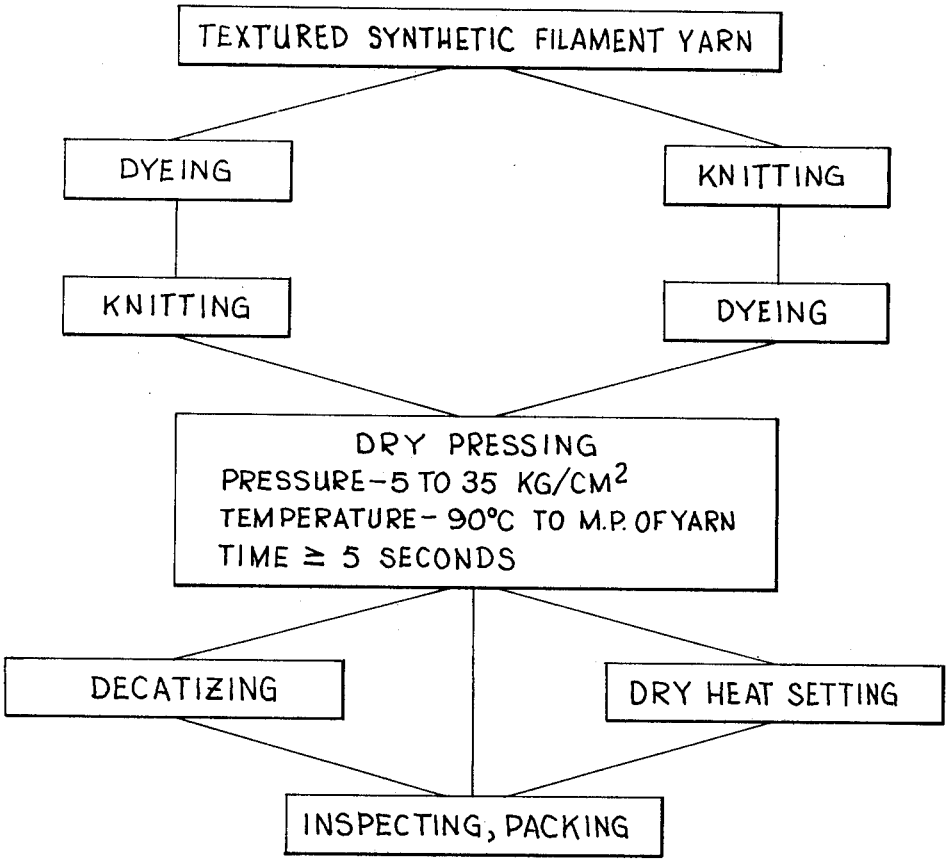

These and further features and advantages of the present invention will be understood upon reading the following, more detailed description along with the accompanying drawings, in which;

FIG. 1(A), FIG. 1(B) and FIG. 1(C) cross-sections of yarn, with FIG. 1(C) showing the cross-section when the yarn is pressed with heating and FIG. 1(B) showing the cross-section when the yarn is pressed without heating, FIG. 2 shows the relationship between temperature and thickness of fabric when the fabric is pressed in a direction along the thickness thereof, FIG. 3 shows the relationship betwen compression pressure applied to a fabric and thickness of the fabric when the fabric is pressed at various temperatures, FIG. 4 shows the relationship between the air permeability of fabric and thickness thereof when the fabric is pressed, FIGS. 5 and 6 explain a method for the measurement of surface contour of fabric, FIG. 7 shows an apparatus for the measurement of the surface frictional coefficient of fabrics, and FIG. 8 is a flow diagram of the process of the invention.

The primary knitted fabrics usable for the process of the present invention can be selected from knitted fabrics, such as jerseys, tricots, and the like containing at least 50% of thermoplastic synthetic fibers, including stable fibers and filaments. Preferably the primary knitted fabrics can be selected from knitted fabrics having a relatively high weight, such as double jerseys, double tricots and the like.

The primary fabric can be made of thermoplastic synthetic multifilament yarns, particularly, textured yarns or spun yarns.

If the content of the thermoplastic synthetic fibers is lower than 50%, the primary knitted fabric can not be converted to knitted fabric having woven fabric-like appearance and hand through the process of the present invention.

The thermoplastic synthetic fibers usable for forming the primary knitted fabric for the present invention may be selected from fibers made of the polymers selected from polyamides such as nylon 6, nylon 7, nylon 9, nylon 11, nylon 12, nylon 66, nylon 610 and copolymers and mixtures of the foregoing polyamides; polyesters such as polyethylene terephthalate, polymethylene terephthalate, polytetramethylene terephthalate, polycyclohexylene dimethylene terephthalate and copolymers and mixtures of the foregoing polyesters; polyolefins such as polyethylene and polypropylene and copolymers and mixtures of the foregoing polyolefins and mixtures mainly containing the foregoing polymers. The above-stated synthetic fibers can be plasticized and heat-set at a temperature lower than the melting point thereof, but not lower than 90° C.

Generally, it is well-known that when thermoplastic synthetic fibers are heated to a high temperature, the rigidity and stress for compression of the synthetic fibers decrease but the internal strain thereof increases. The inventors had recognized through the study thereof the fact that, when a fiber mass containing thermoplastic synthetic fibers is compressed at a high temperature, the synthetic fibers, which initially are present in a crowded portion of the fabric, move to a less crowded portion. That is, when the thermoplastic synthetic fibers distributed in the fiber mass are compressed at a high temperature, the synthetic fibers have a tendency of moving to a more stable condition while plastically deforming in the direction of the compressing. Based upon the above tendency, when the knitted fabric containing thermoplastic synthetic yarns is pressed in the thickness direction of the fabric, namely, substantially at a right angle with respect to the fabric surface, at a high temperature, the knitting yarns in the fabric are deformed so as to occupy the open free spaces between the stitches of the knitting yarns and are stabilized in the spaces. In this pressing, the above-stated behavior of the thermoplastic fibers in the knitting yarn acts so as to enforce the occupation of the open free space by the deformed knitting yarns, and the fibers are heat-set at the high temperature in the deformed condition.

At the same time, the fabric surface is pressed with a presser having a flat face or a pressing roller so as to deform into an even and smooth surface.

The behavior of the thermoplastic synthetic fabric under a compression pressure at a high temperature is schematically illustrated in FIG. 1.

Referring to FIG. 1, when a yarn 1 laid on a flat plate 2 is pressed with a plate 3 at normal temperature, the yarn A is deformed from the state of FIG. 1(A) to the state of FIG. 1(B) so as to become thinner than the original thickness of the yarn 1. In this case, generally, the cross-sectional area of the yarn in state FIG. 1(B) is smaller than that of state FIG. 1(A), and therefore, the apparent density of the yarn in state FIG. 1(B) is greater than that of state FIG. 1(A), respectively. Compared with the above case, when the yarn 1 is compressed between the plates 2 and 3 at a high temperature under the same pressure as that of state FIG. 1(B), the thickness of the yarn 1 is made thin as shown in state FIG. 1(C). However, in this case, since the thermoplastic fibers in the yarn 1 laterally move towards the outside of the yarn, the cross sectional area of the yarn 1 in state FIG. 1(C) is larger than that of state FIG. 1(B). It is shown that when the yarn containing the thermoplastic synthetic fibers is pressed, heating the yarn to a high temperature is effective for inhibiting the increase of apparent density of the yarn. The deformation of the cross-sectional profile of the yarn by pressing depends on compressive pressure, pressing time period, pressing temperature and, additionally, moisture content of the yarn. Particularly, the pressing temperature (° C) has an important effect for deformation degree ($\rho$%) of the fabric in the thickness direction thereof. The deformation degree ($\rho$%) will be defined hereinafter.

Referring to FIG. 2, under a constant compression pressure, pressing time and moisture content condition, the relation curve 4 between the pressing temperature (T° C) and the deformation degree ($\rho$%) has a turning point 5. That is, the deformation degree ($\rho$%) of the fabric remarkably increases at temperatures higher than the turning point 5.

The present invention is effective for imparting a higher surface smoothness, luster and heat retaining properties and a lower air permeability of the knitted fabrics which have lower values thereof than those of the woven fabrics, by effectively utilizing the thermoplastic properties of the thermoplastic synthetic fibers in the fiber mass, particularly, the behavior at the high temperature.

The deformation degree ($\rho$%) of the fabric is determined by the following equation:

$$\rho = \frac{D_o - D_1}{D_o} \times 100\ (\%)$$

wherein $D_o$ is a thickness of the original knitted fabric and $D_1$ is a thickness of the pressed knitted fabric.

The thickness of the fabric is measured in accordance with ASTM D 1777–64.

In the process of the present invention, it is preferable that the deformation degree ($\rho$%) is in a range from 5 to 45%, more preferably, from 15 to 35%.

The pressing conditions for obtaining the results in the above preferable range for deformation degree ($\rho$%) may be selected in consideration of the kind of thermoplastic fibers in the knitted fabric, and specified on temperature, pressure and time.

In the process of the present invention, the knitted fabric containing at least 50% by weight of thermoplastic synthetic fibers is pressed substantially at a right angle with respect to the fabric surface at a temperature lower than the melting point of the thermoplastic fibers but not lower than 90° C under a compression pressure of 5 to 35, preferably, 10 to 25 kg/cm². When the temperature and pressure are lower than the above-mentioned lower limits, the deformation degree ($\rho$%) of the fabric is insufficiently low and therefore, the resultant fabric can not have the woven fabric-like appearance and hand. When the temperature is higher than the above-mentioned upper limit, the deformation degree of the fabric is too high and results in melting of the thermoplastic fibers, whereby the molten fibers adhere to each other, the hand is remarkably damaged and thus, the commercial value of the fabric is lowered. When the pressure is higher than 35 kg/cm², the pressed fabric has too low a thickness and is unsuitable for actual wear.

The period of time for pressing the knitted fabric in accordance with the process of the present invention should be sufficient for substantially setting the knitted fabric into the pressed form. The time period is preferably 5 seconds or longer. Since in order to transfer heat from the heating face of the presser, such as a heating plate or a heating roller into the knitted fabric so as to heat the fabric to the predetermined temperature, some time period is necessary. If the time is shorter than 5 seconds, the pressed fabric tends to be unsatisfactorily or nonuniformly set.

Through the above process of the present invention, the objects of the present invention can be accomplished. When the above process is followed by the additional process as is mentioned hereinafter, the pressed fabric can be permanently set in the pressed form. That is, after the knitted fabric is pressed in accordance with the process of the present invention with the dry heating in order to provisionally compress the fabric in the thickness direction thereof, the pressed fabric is treated with steam or dry heated under such a condition that the fabric is pressed at substantially a right angle to the fabric surface under a pressure at a temperature and for a time period suitable for preventing the fabric from recovery of the provisional compression. Through the above additional process, the objects of the present invention are more effectively accomplished. When the additional process is effected by the steam heating manner, it is preferable that the pressed fabric is treated at a temperature lower than the melting point of the thermoplastic synthetic fibers but not lower than 100° C, preferably 110° C under a pressure of at least 100 g/cm² for at least 2 minutes, preferably, at least 3 minutes in order to relax the internal stresses of the thermoplastic fibers derived from the first pressing while preventing the recovery of the compression. When the additional process is carried out in the dry heating manner, it is preferable that the process is carried out at a temperature of 150° to 200° C, preferably, 170° to 190° C, for at least 5 seconds preferably, not longer than 30 seconds.

Through the above additional process, that is, aftertreatment, the pressed knitted fabric having a thickness of 55 to 95% with respect to the original thickness thereof is set and stabilized and adjusted into the desired appearance and hand.

The actions and effects of the aftertreatment will be explained in detail referring to FIGS. 3 and 4 of the accompanying drawings.

In FIG. 3, curve A shows the relationship between the pressure and the deformation degree of a polyester knitted fabric, which is prepared from a polyethylene terephthalate multifilament textured yarn and having a thickness of 1.03 mm, weight of 230 g/m², pressed at a temperature of 130° C for 20 seconds under a pressure of 0 to 35 kg/cm². In the curve A, it is clear that the deformation degree increases with the elevation of pressure. When polyester knitted fabrics pressed under the above conditions are treated in boiling water for 30 minutes, the treated fabrics are relaxed so that the deforming degree thereof results in the curve B. Compared with curve B, when, after a pressed polyester knitted fabric is aftertreated under such a manner that the fabric is pressed under a pressure of 200 to 300 g/cm² and treated with steam at a temperature of 130° C for 3 minutes, the aftertreated fabric is further treated in boiling water for 30 minutes, the deformation degree of the boiled fabric is shown in curve C which is located above curve B. This shows that the aftertreatment is effective for retaining the dimensions of the pressed knitted fabrics. As stated above, the aftertreatment of the present invention is very effective for stabilizing the pressed knitted fabric so as to prevent the fabric from further deformation, and for promoting filling of the open free spaces between the yarn stitches of the pressed fabric with the thermoplastic fibers therein, whereby the finished fabric has an even and uniform surface.

The pressing apparatus, that is, the presser for effecting the process of the present invention, may be selected from apparatus capable of uniformly pressing the knitting fabric at substantially a right angle to the fabric surfce and evenly heating the fabric. Continuous flat pressers, calender rollers and hot plate pressers with a heater are usable for the process of the present invention.

In the aftertreatment process, means for imparting moisture to the fabric may be utilized and the conventional decatizer, hot-stenter, and hot ager are usable for the aftertreatment.

If the knitted fabric is severely adjusted to a prescribed width and to a constant longitudinal tension by a pin tenter or clip tenter before the pressing or the aftertreatment, the adjusting is very valuable for stabilizing and equalizing the resultant fabric quality.

Further, the process of the present invention may be carried out at the same time, before or after the conventional finishing process, for example, finishing with a softening agent, antistatic agents, heat-resisting agents, light resisting agents, flurorescent whiting agents, pilling resisting agents, soil resisting agents, flame resisting agents and finishing resins.

The process of present invention applied to the primary knitted fabric results in a knitted fabric having a porosity of at most 80% and a surface contour of at most 6, and therefore, an appearance and hand resembling those of the conventional woven fabrics, particularly woven worsted fabrics. The knitted fabrics of the present invention have an even and smooth surface having a low frictional coefficient and a high apparent density and therefore, a relatively lower air permeability owing to occupation of the open free spaces between the yarn stitches by the thermoplastic fibers. The knitted fabrics having the above-mentioned advantages, possesses a high heat retaining property and therefore, are useful for gentlemen's wear, ladies' suits and other clothing.

Generally, it is well-known that woven fabric has a porosity higher than that of knitted fabric if they have the same weight. This is a feature of woven fabrics.

The porosity is defined by the following formula:

$$\text{Porosity } (\%) = \frac{\mathcal{S}\,S}{S} \times 100$$

wherein S is the apparent density of the fabric and $\mathcal{S}$ is the specific gravity of the fiber for forming the fabric.

The knitted fabric obtained from the process of the present invention has a remarkably lower porosity than that of conventional knitted fabrics and therefore, a high heat retaining property and a low air permeability. In FIG. 4, curve D shows the relationship between the deformation degree and the air permeability of the knitted fabric the same as that of FIG. 3, curve A. As is clearly shown in FIG. 4, the air premeability decreases with increase of the deformation degree. This shows the fact that the increase of deformation degree results in increase of occupation degree of the open free spaces in the fabric by the thermoplastic fibers.

As mentioned above, the knitted fabric of the present invention has a porosity of at least 80%. The porosity is an important element together with the surface contour, which will be explained in detail hereinafter, for imparting the woven fabric-like appearance and hand to the knitted fabric. Generally, the conventional knitted or woven fabrics composed of a spun yarn consisting of natural fibers, for example, wool fibers, is subjected to milling in order to increase the density of the fabric so as to adjust the fabric in appearance and features suitable for wear. However, since the synthetic fibers have no milling property, it is necessary, for obtaining a high density fabric, that the yarn is woven or knitted with a high picking or knitting density. In the knitting process, there are limitations, in view of the knitting mechanism or knitting technique, on increasing the knitting density.

The knitted fabric of the present invention has a high apparent density resembling that of woven fabric. This, together with the low surface contour, results in the woven fabric-like appearance and hand. The porosity is a parameter for controlling the apparent density of the knitted fabric. If the porosity is higher than 80%, the knitted fabric can not possess the woven fabric-like appearance. Preferably, the knitted fabrics of the present invention have a porosity of 75 to 40%.

Next, the surface contour of the fabric will be explained in detail referring to FIGS. 5 and 6 of the accompanying drawings.

A cross-section of the knitted fabric in the thickness direction thereof is shown in FIG. 5. Referring to FIG. 5, $x$-axis is taken substantially in parallel with the fabric surface and $y$-axis is taken at a right angle to the fabric surface. Accordingly, the length and thickness of the fabric are shown on the $x$ and $y$ axes, respectively. The cross-section is divided by numerous straight lines drawn in parallel with the $y$-axis at intervals of 0.05 mm as shown in FIG. 5. Each of the divided portions are referred to as a small section. In the small section $S_n$, as shown in FIG. 5, the co-ordinate of the cross-sectional top end of the fiber located at the uppermost portion of the fabric is of $(x_n, y_n)$. In this case, a straight line ($y = a$) meet the point $(x_n, y_n)$, therefore, distance $y_n = a$. Through the above manner, the co-ordinates of the cross-sectional top ends of the fibers located at the uppermost positions in the small sections are determined.

Referring to FIG. 6, all of the co-ordinates of the cross-sectional top ends are plotted and connected to each other with straight lines. The graphic line 6 prepared thus is referred to as a surface contour graph.

A surface contour graph for the knitted fabric shown in FIG. 5 and having an actual length of 1 cm is prepared and then divided into 10 sections with straight lines drawn in parallel with the $y$ axis at intervals at 1.0 mm. These divided sections are referred to as large sections. FIG. 6 shows the surface contour graph in about two and a half large sections. In the large section Dm in FIG. 6, let a maximum value of the surface contour be $y$ max and a minimum value of the surface contour be $y$ min.

Further, let the difference between $y$ max and $y$ min be Lm. Accordingly, $y$ max $-$ $y$ min $=$ Lm.

The Lm for each large section is measured. When a number R of a large section having the Lm of 0.15 or more is found in the ten large sections, the surface contour of the knitted fabric is represented as R.

The observation of the knitted fabric cross-section for measurement of the surface contour is carried out in the following manner. The knitted fabric to be measured is embedded in a melt of ethylene-maleic acid copolymer having a molecular weight of 2,000, a melting point of 100° C and an acid value of 15 at a temperature of 120° C and then solidified. The embedded knitted fabric is sliced at a right angle with respect to the fabric surface at intervals of 0.05 mm. The surface contour of the measured knitted fabric is represented at an average value of measurements on fine portions of the fabric.

The knitted fabric of the present invention has a surface contour of at most 6, preferably, 4 or less, more preferably, 2 or less, on at least one face thereof. The surface contour is a parameter for the smoothness and evenness of the fabric surface. Accordingly, the smaller the surface contour of the fabric face, the smoother the surface and the smaller the surface frictional coefficient. The high smoothness of the fabric face is an important element for obtaining the knitted fabric having the woven fabric-like appearance with observation by the naked eye and slippery hand. If the surface contour is higher than 6, the knitted fabric can not be provided with the woven fabric-like appearance and hand because of the uneven surface thereof.

The knitted fabric containing at least 50% by weight of the thermoplastic synthetic fibers and having the abovelimited porosity and surface contour has an appearance and hand resembling those of woven fabric in the sense of sight and hand. A functional test for the knitted fabric of the present invention by 60 testing members resulted in the fact that all of the testing members identified the knitted fabric as a woven fabric.

Through the process of the present invention, the spaces between the yarn stitches are filled by the thermoplastic fibers moved during the heat-pressing process so as to increase the smoothness of the fabric surface and decrease the porosity thereof. In the conventional finishing processes for synthetic fiber knitted fabrics, the knitting yarn is subjected to relaxation of the bundling thereof under a wet condition at a high temperature in order to uniformly distribute the fibers in the knitting yarn. Accordingly, the filling of the spaces between the yarn stitches with the fibers can not be accomplished in contrast with that of the process of the present invention.

Also, in the conventional finishing processes for wool fiber fabrics, the filling of the spaces between the yarn stitches and the imparting of the covering property are accomplished by means of a milling machine or scouring machine by utilizing the milling property of wool fibers. However, it is impossible that the wool fiber knitted fabric is imparted a surface smoothness and set into the smooth face by the milling process. Therefore, the wool fiber knitted fabrics subjected to the milling can not have the woven fabric-like appearance and hand.

Further, the conventional pressing for the wool fiber knitted or woven fabrics by using the batch-type flat presser, batch-type electric presser or continuous flat presser, is carried out in order to improve only the smoothness of the fabric faces, and therefore, is different from the process of the present invention due to the low heating temperature of the pressers.

As described above in detail, the present invention is remarkably valuable for providing the novel knitted fabric by imparting the woven fabric-like appearance and hand to the knitted fabric while retaining the good features such as low weight and high softness, of the knitted fabric itself for clothing wear. Based upon the present invention, it is possible to apply the synthetic fiber knitted fabrics to uses for gentlemen's wear and ladies' formal suits.

The present invention, accordingly, is very effective for mass production and diversification of clothing wear material.

The following examples are illustrative of the present invention.

EXAMPLE 1

A polyester multifilament yarn having a fineness of 150 denier/48 filaments was prepared from a polyethylene terephthalate having an intrinsic viscosity of 0.5 through usual spinning and drawing steps. The yarn was false-twisted so as to be converted to a textured yarn. The obtained textured polyester yarn was dyed by a high pressure dyeing method and then knitted into a Blister double jersey having a weight of 230 g/m² and a thickness of 1.03 mm using a conventional circular knitting machine. The double jersey obtained above was of a porosity of 84% and surface contour of 9 and a normal knitted fabric appearance.

The double jersey was is hereinafter referred to as a primary jersey for the present example.

The primary jersey was divided into seven pieces, of which four pieces were subjected to the treatment according to the process of the present invention under the processing conditions as illustrated in Table 1. These pieces are referred to as Fabrics, A, B, C and D in Table 1, respectively. For comparison, one of the divided primary jerseys was maintained without processing, and two pieces were subjected to comparison processes other than that of the present invention under the processing conditions as illustrated in Table 1. These comparision pieces are referred to as Comparison Fabrics *a*, *b*, and *c*.

In the processings illustrated in Table 1, the pressed pieces were wound onto a tube under compression pressures effecting the pieces in the thickness direction thereof as illustrated in Table 1 and then charged into a decatizer in order to decatize them at the temperatures for the time periods illustrated in Table 1.

As is clearly shown in Table 1, Fabrics A, B, C and D which were processed according to the process of the present invention has a porosity lower than 80% and a surface contour lower than 6 so as to satisfy the definition of the fabric of the present invention. Compared with those, Comparison Fabrics *a* and *c* had a porosity higher than 80%, a surface contour higher than 6, and Comparison Fabric *b* has a surface contour higher than 6 whereas its porosity was slightly lower than 80%.

Table 1

| Item | | | Fabric A | B | C | D | Comparison a | b | c |
|---|---|---|---|---|---|---|---|---|---|
| Process | Processing | Temperature (°C) | 130 | 130 | 120 | 110 | | 80 | |
| | | Pressure (kg/cm²) | 20 | 15 | 10 | 20 | non | 3 | non |
| | | Time (sec) | 20 | 10 | 10 | 20 | | 3 | |
| | Decatizing | Temperature (°C) | 130 | 130 | 120 | 110 | | 90 | 95 |
| | | Pressure (g/cm²) | 300 | 300 | 500 | 1000 | non | 50 | 80 |
| | | Time (min) | 5 | 10 | 5 | 10 | | 1 | 2 |
| result | Porosity (%) | | 50 | 58 | 76 | 65 | 84 | 78 | 85 |
| | Surface contour | | 2 | 4 | 5 | 3 | 9 | 8 | 9 |
| | Appearance and hand | | resemblance to woven fabric | | | | no resemblance to woven fabric | | |
| | Air permeability (cc/cm²/sec) | | 46 | 65 | 72 | 57 | 208 | 126 | 147 |
| | Surface frictional coefficient | Warp | 0.344 | 0.364 | 0.364 | 0.364 | 0.445 | 0.404 | 0.424 |
| | | Filling | 0.424 | 0.466 | 0.488 | 0.424 | 0.675 | 0.601 | 0.649 |

Comparing the Fabrics A, B, C and D with Comparison Fabrics *a*, *b* and *c* in air permeability and surface frictional coefficient, of which measurement methods will be illustrated hereinafter, it was recognized that the Fabrics A, B, C and D processed according to the process of the present invention had a higher surface smoothness and apparent density than those of Comparison Fabrics *a*, *b* and *c* which were processed according to other processes than that of the present invention or maintained without processing, so as to have a woven worsted fabric-like appearance and hand. Compared with this, Comparison Fabrics *a*, *b* and *c* failed to have the woven fabric-like appearance and hand due to the high surface contour and porosity thereof.

The air permeability of the fabrics was determined through the measurement according to ASTM D 737-67 using the Fragile type testing machine.

The surface frictional coefficient of the fabrics was determined through the measurement in accordance with the following manner using the testing device shown in FIG. 7. Referring to FIG. 7, the test piece 71 is put on a plate 72 and a weight 73, which is covered with a nylon taffeta cloth, is put on the test piece 71. Inclining the plate 72 gradually, an angle $\theta$ at which the weight 73 begins to slides down on the surface of the test piece 71 is measured. The surface frictional coefficient is obtained from the equation:

Frictional coefficient (Ms) = $\tan\theta$.

EXAMPLE 2

A polyamide multifilament yarn having a fineness of 150 denier/32 filaments was prepared from a polycapramide having an intrinsic viscosity of 1.18 through conventional spinning and drawing steps. The yarn was false-twisted so as to be converted to a textured yarn by the conventional process, and then dyed with an acid dye by the conventional dyeing process. The dyed yarn was knitted into a Blister double jersey having a weight of 210 g/m², a porosity of 88% and a surface contour of 10. The resultant jersey had a normal appearance and hand as the knitted fabric. The above jersey was referred to as a primary fabric for the present example.

The primary fabric was divided into seven pieces of which four pieces were subjected to the process according to the present invention under the processing conditions as illustrated in Table 2. These pieces are referred to as Fabric E, F, G and H.

For comparison, one of the primary fabric pieces was maintained without processing and the other two pieces were subjected to processes other than that of the present invention under the processing conditions as illustrated in Table 2. These comparison pieces are referred to as Comparison Fabrics *d*, *e* and *f*.

Table 2

| Item | | | Fabric E | F | G | H | Comparison d | e | f |
|---|---|---|---|---|---|---|---|---|---|
| Process | Processing | Temperature (°C) | 100 | 95 | 120 | 110 | | | 80 |
| | | Pressure (kg/cm²) | 10 | 5 | 10 | 15 | non | non | 4 |
| | | Time (sec) | 20 | 20 | 10 | 10 | | | 4 |
| | Decatizing | Temperature (°C) | 100 | 95 | 130 | 110 | | 90 | 90 |
| | | Pressure (g/cm²) | 200 | 200 | 500 | 1000 | non | 80 | 80 |
| | | Time (min) | 5 | 5 | 10 | 8 | | 2 | 2 |
| Result | Porosity (%) | | 72 | 63 | 36 | 40 | 88 | 83 | 82 |
| | Surface contour | | 3 | 5 | 1.5 | 2 | 10 | 8 | 7 |
| | Appearance and hand | | resemblance to woven fabric | | | | no resemblance to woven fabric | | |
| | Air permeability (cc/cm²/sec) | | 73 | 88 | 40 | 55 | 230 | 175 | 166 |
| | Surface frictional coefficient | Warp | 0.344 | 0.364 | 0.325 | 0.325 | 0.445 | 0.424 | 0.424 |
| | | Filling | 0.424 | 0.445 | 0.364 | 0.384 | 0.675 | 0.577 | 0.554 |

As understood from Table 2, Fabrics E, F, G and H which were processed in accordance with the present invention, had a porosity lower than 80% and a surface contour lower than 6 so as to satisfy the definition for the fabric of the present invention and to have the woven fabric-like appearance and hand. Compared with those, Comparison Fabrics *d*, *e* and *f* had a porosity and surface contour higher than the upper limit of the definition, and therefore, could not have the woven fabric-like appearance and hand.

Through the measurements of the air permeability and surface frictional coefficient of Fabrics of the present invention and Comparison Fabrics, as shown in Table 2, it was recognized that Fabrics E, F, G and H had surface smoothnesses and apparent densities higher than those of Comparison Fabrics *d*, *e* and *f*, and similar to those of the conventional woven worsted fabric.

EXAMPLE 3

Polyester stable fibers having a fineness of 5 denier and a length of 5 cm were prepared from a polyethylene terephthalate having an intrinsic viscosity of 0.68 by the conventional spinning and drawing processes. After dyeing, the polyester stable fibers were blended with dyed wool fibers in blend ratios by weight of 40 : 60, 60 : 40 and 80 : 20. The above blends and the polyester staple fibers were separately spun into yarns of a metric count number of 48. Each of the resultant yarns was doubled and twisted into a two-fold yarn. The resultant two-fold yarns were subjected to knitting so as to form Blister double jerseys by using the conventional circular knitting machine. The results were normal knitted fabrics having a weight of 240 g/m₂, a porosity of 82% and a surface contour of 12.

The resultant knitted fabrics are referred to as Fabric I which was prepared from the blend of 60% by weight of polyester fibers and 40% by weight of wool fibers, Fabric J which was prepared from the blend of 80% by weight of polyester fibers and 20% by weight of wool fibers, Fabric K which was prepared from 100% of polyester fibers, and Comparison Fabric *g* which was prepared from the blend of 40% of polyester fibers and 60% by weight of wool fibers. Fabrics I, J and K and Comparison Fabric *g* were subjected to pressing at a temperature of 110° C under a compression pressure of 15 kg/cm²for 20 seconds using a continuous flat presser, and then to decatizing at a temperature of 115° C under a pressure of 300 g/cm² for a time of 3 minutes.

The properties of the resulting fabrics are shown in Table 3.

Table 3

| Item | Fabric | | I | J | K | Comparison g |
|---|---|---|---|---|---|---|
| Process | Blend ratio of polyester fibers to wool fibers | | 60/40 | 80/20 | 100/0 | 40/60 |
| | Porosity (%) | | 77 | 51 | 40 | 82 |
| | Surface contour | | 5 | 4 | 3 | 12 |
| Result | Appearance and hand | | resemblance to woven fabric | | | no resemblance to woven fabric |
| | Air permeability (cc/cm²/sec) | | 65 | 82 | 57 | 155 |
| | Surface frictional coefficience | Warp | 0.404 | 0.384 | 0.364 | 0.445 |
| | | Filling | 0.466 | 0.445 | 0.424 | 0.753 |

Fabrics I, J and K which contained the polyester fibers with a content higher than the lower limit for the synthetic fiber content defined in the present invention, had a porosity lower than 80% and a surface contour lower than 6 so as to satisfy the definition for the fabric of the present invention. These fabrics has a desirable woven worsted fabric-like appearance and hand. Compared with this, Comparison Fabric *g*, which contained the polyester fibers with a content lower than the lower limit, namely, 50% by weight for the synthetic fiber content defined in the present invention, could not have the woven fabric-like appearance and hand.

EXAMPLE 4

A polyester multifilament yarn having a fineness of 150 denier/48 filaments was prepared from a polyethylene terephthalate having an intrinsic viscosity of 0.65 through the conventional spinning and drawing process. The yarn was false-twisted so as to form a textured yarn and then dyed by the conventional process. The dyed yarn was subjected to knitting into a triple interlock double jersey having a weight of 200 g/m², a porosity of 90% and a surface contour of 9. The resultant jersey has a normal appearance and hand as a knitted fabrics and is referred to as the primary fabric for the present example.

The primary fabric was divided into seven pieces of which four were subjected to the process according to the present invention under the processing conditions shown in Table 4. These fabrics are referred to as Fabrics L, M, N and P. One of the pieces was kept under a non-processed condition and the other two pieces were subjected to processes other than that of the present invention under the processing conditions shown in Table 4. These fabrics are referred to as Comparison Fabrics *h*, *i* and *j*.

The processing of Fabrics L, M, N and P and Comparison Fabrics *i* and *j*, the pressing was carried out using a continuous flat presser under a dry condition and then the pressed fabrics were heat set under a dry condition using a pin stenter-type heat-setter. Comparison Fabric *h* was maintained under the non-processed condition.

The resultant properties are shown in Table 4.

Referring to Table 4, Fabrics L, M, N and P of the present example has a porosity lower than 80% and a surface contour lower than 6 so as to satisfy the definition for the fabric of the present invention. Further, Fabrics L, M, N and P has an air permeability and surface frictional coefficient lower than those of Comparison Fabrics, *h*, *i* and *j*, which had a porosity higher than 80% and a surface contour higher than 6. Accordingly, Fabrics L, M, N and P had a desirable appearance and hand similar to those of the woven worsted fabric, owing to the high surface smoothness and apparent density.

Table 4

| Item | | Fabric | L | M | N | P | Comparison h | i | j |
|---|---|---|---|---|---|---|---|---|---|
| Process | Pressing | Temperature (°C) | 130 | 120 | 110 | 90 | non | non | 80 |
| | | Pressure (kg/cm²) | 30 | 20 | 10 | 5 | | | 3 |
| | | Time (sec) | 20 | 20 | 30 | 40 | | | 4 |
| | Heat setting | Temperature (°C) | 180 | 180 | 170 | 160 | non | 180 | 140 |
| | | Time (sec) | 15 | 10 | 25 | 20 | | 10 | 10 |
| Result | Porosity (%) | | 37 | 46 | 65 | 75 | 90 | 92 | 88 |
| | Surface contour | | 2 | 4 | 5 | 6 | 9 | 11 | 10 |
| | Appearance and hand | | resemblance to woven fabric | | | | no resemblance to woven fabric | | |
| | Air permeability (cc/cm²/sec) | | 42 | 58 | 73 | 85 | 240 | 258 | 174 |
| | Surface frictional coefficient | Warp | 0.364 | 0.384 | 0.404 | 0.445 | 0.577 | 0.625 | 0.510 |
| | | Filling | 0.404 | 0.424 | 0.445 | 0.488 | 0.649 | 0.675 | 0.577 |

EXAMPLE 5

A knitted fabric made of polyester textured filament of 100 denier/32 filaments yarn having a weight of 230 g/m², thickness of 1.03 mm, a porosity of 90%, a surface contour of 15, and air permeability of 128 cc/cm²/sec was pressed using a continuous flat presser at a temperature of 140° C under a pressure of 15 kg/cm² directed along the thickness of the knitted fabric for 30 seconds. The resultant fabric had a thickness of 0.82 mm which corresponds to a thickness of 80% with respect to that of the original knitted fabric, a porosity of 63%, a surface contour of 3 and an air permeability of 70 cc/cm²/sec.

The resultant fabric had a preferable appearance and hand similar to those of woven worsted fabric due to the high surface smoothness and density thereof.

EXAMPLE 6

A polyester knitted fabric having a weight of 230 g/m², a thickness of 1.03 mm, a porosity of 88%, a surface contour of 9 and an air permeability of 128 cc/cm²/sec was prepared from a polyethylene terephthalate multifilament textured yarn having a fineness of 150 denier/36 filaments.

The knitted fabric was pressed using the same flat presser as that of Example 5 at a temperature of 130° C under a pressure of 20 kg/cm² for for 20 seconds. The pressed knitted fabric was decatized in a decatizer at a temperature of 130° C under a compression pressure of 300 to 400 g/cm² for 5 minutes. The resultant fabric had a thickness of 0.67 mm which corresponded to 65% thickness with respect to that of the original fabric, a porosity of 55%, a surface contour of 3 and an air permeability of 46 cc/cm²/sec. The above fabric had a desirable surface luster and a high density observed by the naked eye, which is derived from compression of the knitting yarns so as to fill the spaces between the yarns in the original fabric.

EXAMPLE 7

A polyamide knitted fabric, which was prepared from a polycapramide multifilament textured yarn having a fineness of 150 denier/24 filaments and a weight of 210 g/m², a thickness of 1.06 mm, a porosity of 87%, a surface contour of 12 and an air permeability of 147 cc/cm²/sec, was pressed with the same continuous flat presser as that of Example 5 at a temperature of 100° C, under compression pressure of 5 kg/cm² for 20 seconds and then decatized in a closed decatizer at a temperature of 100° to 105° C under a pressure of 100 to 200 g/cm² for 5 minutes. The resultant polyamide fabric had a thickness of 0.95 mm which corresponded to about 90% thickness with respect to the original fabric, a porosity of 63%, a surface contour of 4 and an air permeability of 95 cc/cm²/sec. The above fabric had a woven worsted fabric-like appearance and hand.

EXAMPLE 8

The same polyester knitted fabric as that of Example 5 was pressed using the same continuous flat presser as that of Example 5 at a temperature of 130° C under a compression pressure of 20 kg/cm² for 20 seconds and then heat-set using a pin stenter-type heat-setter at a temperature of 180° C for 15 seconds. The resultant fabric had a thickness of 0.69 mm which corresponds to 67% thickness with respect to that of the original fabric, a porosity of 44%, a surface contour of 3 and an air permeability of 42 cc/cm²/sec. The above knitted fabric had a desirable appearance and hand similar to those of the woven worsted fabric.

EXAMPLE 9

A knitted fabric was prepared from a blend spun two-fold yarn consisting of 65% by weight of polyethylene terephthalate fibers of a 3 denier fineness and a 80 mm length and 35% by weight of wool fibers and having a metric count number of 48. The knitted fabric had a weight of 240 g/mm², a thickness of 0.85 mm, a porosity of 86%, a surface contour of 10 and an air permeability of 86 cc/cm²/sec. The knitted fabric was pressed using the continuous flat presser as that of Example 5 at a temperature of 110° C under a compression pressure of 15 kg/cm² for 20 seconds and then steam-heated in a decatizer at a temperature of 115° C under a compression pressure of 200 to 300 g/cm² for 3 minutes. The resultant knitted fabric had a thickness of 0.66 mm which corresponded to about 78% with respect to the original fabric thickness, a porosity of 48%, a surface contour of 3 and an air permeability of 43 cc/cm²/sec, and therefore, had a preferable appearance and hand resembling those of the conventional woven worsted fabric.

EXAMPLE 10

The same polyamide knitted fabric as that of Example 7 was pressed in the same manner as that of Example 7 and then wound together with a cotton wrapper cloth under a compression pressure of 850 to 1000 g/cm². The wound knitted fabric was steam-heated in a decatizer at a temperature of 125° C for 8 minutes.

The resultant fabric had a thickness of 0.83 mm which corresponded to about 78% with respect to the original fabric thickness, a porosity of 60%, a surface contour of 5 and an air permeability of 75 cc/cm²/sec, and therefore, had a preferable appearance and hand similar to the conventional worsted fabric.

What we claim is:

1. A process of treating a primary knitted fabric to obtain a treated knitted fabric having the appearance and hand of a woven fabric, comprising:

uniformly dry pressing a primary knitted fabric consisting essentially of a thermoplastic, synthetic, textured filament yarn with a smooth flat presser face under a pressure of from 5 to 35 Kg/cm² applied substantially at a right angle with respect to the surface of said primary knitted fabric, and simultaneously heating the fabric to a temperature between 90° C and the melting point of said thermoplastic yarn for a period of time not less than 5 seconds and effective for setting the treated knitted fabric in a thickness of from 95 to 55% of the original thickness of the knitted fabric, so that the treated knitted fabric has a porosity of at most 80% and at least one surface having a surface contour of at most 6.

2. A process as set forth in claim 1, wherein said primary knitted fabric is selected from jerseys and tricots.

3. A process as set forth in claim 1, wherein said thermoplastic synthetic yarn consists of polymeric material selected from the group consisting of (1) polyamide selected from nylon 6, nylon 7, nylon 9, nylon 11, nylon 12, nylon 66, nylon 610, and copolymers and mixtures thereof; (2) polyesters selected from polyethylene terephthalate, polymethylene terephthalate, polytetramethylene terephthalate, polycyclohexylene dimethylene terephthalate, and copolymers and mixtures thereof; (3) polyolefin selected from polyethylene, polypropylene and copolymers and mixtures thereof; and (4) mixtures of the foregoing polymers.

4. A process as set forth in claim 1, wherein said pressure is in the range from 10 to 25 kg/cm$^2$.

5. A process as set forth in claim 1, wherein said treated knitted fabric is subsequently heat-set at a temperature lower than the melting point of said thermoplastic synthetic yarn but not lower than 100° C.

6. A process as set forth in claim 5, wherein said heat setting is carried out in a decatizer under a compression pressure of at least 100 g/cm$^2$ in the thickness direction thereof for at least 2 minutes by using steam as a heating medium.

7. A process as set forth in claim 5, wherein said heat setting is carried out at a temperature of 150° to 200° C by using hot air as a heating medium.

* * * * *